United States Patent [19]

Fountain et al.

[11] 4,310,354

[45] Jan. 12, 1982

[54] PROCESS FOR PRODUCING A SHAPE MEMORY EFFECT ALLOY HAVING A DESIRED TRANSITION TEMPERATURE

[75] Inventors: Richard W. Fountain, New Hartford; William J. Boesch, Utica; Steven H. Reichman, New Hartford, all of N.Y.

[73] Assignee: Special Metals Corporation, New Hartford, N.Y.

[21] Appl. No.: 111,047

[22] Filed: Jan. 10, 1980

[51] Int. Cl.[3] ..... B22F 3/00

[52] U.S. Cl. ..... 75/211; 75/200; 75/214; 75/246

[58] Field of Search ..... 75/200, 211, 214, 246

[56] References Cited

U.S. PATENT DOCUMENTS

| | | | |
|---|---|---|---|
| 3,012,882 | 12/1961 | Muldawer et al. | 75/134 |
| 3,174,851 | 3/1965 | Buehler et al. | 75/170 |
| 3,529,958 | 9/1970 | Buehler | 75/170 |
| 3,700,434 | 10/1972 | Abkowitz et al. | 75/246 |
| 3,716,354 | 2/1973 | Reen | 75/128 W |
| 3,775,101 | 11/1973 | Freche et al. | 75/214 |
| 4,035,007 | 7/1977 | Harrison et al. | 75/170 |
| 4,037,324 | 7/1977 | Andreasen | 32/14 A |
| 4,144,057 | 3/1979 | Melton et al. | 75/134 C |

OTHER PUBLICATIONS

Jackson et al., NASA Publication (SP5110), "55-Nitinol-The Alloy With a Memory: Its Physical Metallurgy, Properties and Applications".

*Primary Examiner*—Brooks H. Hunt

*Attorney, Agent, or Firm*—James C. Valentine; John K. Williamson

[57] ABSTRACT

A process for producing a shape memory effect alloy having a desired transition temperature. The process includes the steps of: providing at least one prealloyed powder of a shape memory effect alloy having a chemistry similar to that of the to be produced alloy and a transition temperature below the desired transition temperature of the to be produced alloy; providing at least one other prealloyed powder of a shape memory effect alloy having a chemistry similar to that of the to be produced alloy and a transition temperature in excess of the desired transition temperature of the to be produced alloy; blending said prealloyed powders; consolidating said blended powders; and thermally diffusing said consolidated powders so as to provide a substantially homogeneous alloy of the desired transition temperature.

5 Claims, No Drawings

PROCESS FOR PRODUCING A SHAPE MEMORY EFFECT ALLOY HAVING A DESIRED TRANSITION TEMPERATURE

The present invention relates to a process for producing a shape memory effect alloy having a desired transition temperature.

Shape memory effect or heat recoverable alloys are those which begin to return or begin an attempt to return to their original shape on being heated to a critical temperature, after being formed at a lower temperature. Such alloys are characterized by a phase change which starts at the critical temperature, hereinafter identified as the transition temperature. One such alloy is primarily comprised of nickel and titanium.

As the transition temperatures of shape memory effect alloys fluctuates with small changes in chemistry, it is difficult to consistently manufacture shape memory effect alloys having desired transition temperatures. Variations in chemistry as small as 0.25% can cause excessive fluctuations. Accordingly, there is a need for a process by which shape memory effect alloys having desired transition temperatures can consistently be produced.

Through the present invention there is provided a process for producing shape memory effect alloys having desired transition temperatures. Two or more prealloyed powders, each having a chemistry similar to the to be produced alloy, are blended, consolidated and thermally diffused to produce an alloy having the desired transition temperature. At least one of the prealloyed powders has a transition temperature below the desired transition temperature. At least one other has a transition temperature in excess of the desired transition temperature.

The uniformity of prealloyed powders renders them an integral part of the subject invention. Prealloyed powders are those wherein each element of the alloy is present in each particle of powder in substantially equal amounts.

A number of references disclose shape memory effect alloys. These references include U.S. Pat. Nos. 3,012,882, 3,174,851, 3,529,958, 3,700,434, 4,035,007, 4,037,324 and 4,144,057, a 1978 article from Scripta Metallurgica (Volume 12, No. 9, pages 771–776) entitled, "Phase Diagram Associated with Stress-induced Martensitic Transformations in a Cu-Al-Ni Alloy", by K. Shimizu, H. Sakamoto and K. Otsuka and a 1972 NASA publication (SP 5110) entitled, "55 - Nitinol - The Alloy With A Memory: Its Physical Metallurgy, Properties and Applications", by C. M. Jackson, H. J. Wagner and R. J. Wasilewski. None of them disclose the powder metallurgy process of the subject invention. Reference to powder metallurgy techniques is, however, found in the NASA publication and in cited U.S. Pat. Nos. 3,700,434 (claim 1), 4,035,007 (column 6, line 12) and 4,144,057 (column 2, lines 42–43). Other references, U.S. Pat. Nos. 3,716,354, 3,775,101 and 4,140,528, disclose prealloyed powders.

It is accordingly an object of the subject invention to provide a process for producing a shape memory effect alloy having a desired transition temperature.

The process for producing the shape memory effect alloy of the subject invention, comprises the steps of: providing at least one prealloyed powder of a shape memory effect alloy having a chemistry similar to that of the to be produced alloy and a transition temperature below the desired transition temperature of the to be produced alloy; providing at least one other prealloyed powder of a shape memory effect alloy having a chemistry similar to that of the to be produced alloy and a transition temperature in excess of the desired transition temperature of the to be produced alloy; blending said prealloyed powders; consolidating said blended powders; and thermally diffusing said consolidated powders so as to provide a substantially homogeneous alloy of the desired transition temperature. The relative amounts of the blended powders are determined empirically, as phase boundaries which define the intermetallic regions in which the powders are present are neither linear nor precise. Each of the powders are, however, of a chemistry which is within the same intermetallic region as that of the to be produced alloy as would be depicted on a phase diagram for said alloy system. In a particular embodiment, the invention includes the step of producing the prealloyed powders via atomization procedures well known to those skilled in the art.

The shape memory effect alloy can be any of those discussed in the references cited hereinabove, as well as others which are now or later known to those skilled in the art. Included therein are the nickel-titanium alloys of U.S. Pat. Nos. 3,174,851, 3,529,958, 3,700,434, 4,035,007, 4,037,324 and 4,144,057 and of the NASA publication; the gold-cadmium, silver-cadmium and gold-silver-cadmium alloys of U.S. Pat. No. 3,012,882; and the copper-aluminum-nickel and copper-zinc alloys of the cited Scripta Metallurgica article.

Transition temperatures can be determined from alloys in any of several conditions which include powder, hot isostatically pressed powder and cold drawn material. Measuring means include differential scanning calorimetry, electrical resistivity and dilatometry.

Although the subject invention applies to any number of shape memory effect alloys, nickel-titanium alloys are probably the most important; and accordingly, the following example is directed to such an embodiment. Nickel-titanium shape memory effect alloys generally contain at least 45 wt. % nickel and at least 30 wt. % titanium, and may contain a wide variety of additions which include copper, aluminum, zirconium, cobalt, chromium, tantalum, vanadium, molybdenum, niobium, palladium, platinum, manganese and iron. Binary shape memory effect alloys of nickel and titanium contain from 53 to 62 wt. % nickel.

Two nickel-titanium alloys (alloys A and B) were atomized, hot isostatically pressed, hot swaged, cold drawn and annealed. The alloys were of the following chemistry:

| Alloy | Ni (wt. %) | Ti (wt. %) |
|---|---|---|
| A. | 54.5 | 45.5 |
| B. | 54.8 | 45.2 |

Electrical resistivity measurements were made on the cold drawn material to determine the austenite start ($A_s$) and austenite finish ($A_f$) temperatures. Nickel-titanium alloys transform to austenite on heating. The $A_s$ temperature is therefore the transition temperature. The $A_s$ and $A_f$ temperatures were as follows:

| Alloy | $A_s$ | $A_f$ |
|---|---|---|
| A. | 28° C. | 55° C. |

-continued

| Alloy | $A_s$ | $A_f$ |
|---|---|---|
| B. | −8° C. | 24° C. |

Note the fluctuation in transition temperature created by the small variation (0.3%) in chemistry between Alloys A and B.

To produce an alloy with $A_s$ and $A_f$ temperatures between those of Alloys A and B, a blend was made with 50% of Alloy A powder and 50% of Alloy B powder. The blend was subsequently processed as were the unblended powders.

Electrical resistivity measurements were made to determine the $A_s$ and $A_f$ temperatures, which were as follows:

| $A_s$ | $A_f$ |
|---|---|
| 15° C. | 40° C |

The $A_s$ and $A_f$ temperatures show that the subject invention does indeed provide a process for producing a shape memory effect alloy having a desired transition temperature.

For determining the scope of the subject invention, it is noted that the transition temperature could be any of those which occur when a material starts or finishes a phase change on heating or cooling. Likewise, the desired transition temperature could encompass a range, and is not necessarily a specific value.

It will be apparent to those skilled in the art that the novel principles of the invention disclosed herein in connection with specific examples thereof will support various other modifications and applications of the same. It is accordingly desired that in construing the breadth of the appended claims they shall not be limited to the specific examples of the invention described herein.

We claim:

1. A process for producing a shape memory effect alloy having a desired transition temperature, which comprises the steps of: providing at least one prealloyed powder of a shape memory effect alloy having a chemistry similar to that of the to be produced alloy and a transition temperature below the desired transition temperature of the to be produced alloy; providing at least one other prealloyed powder of a shape memory effect alloy having a chemistry similar to that of the to be produced alloy and a transition temperature in excess of the desired transition temperature of the to be produced alloy; blending said prealloyed powders; consolidating said blended powders; and thermally diffusing said consolidated powders so as to provide a substantially homogeneous alloy of the desired transition temperature.

2. A process according to claim 1, including the step of producing said prealloyed powders.

3. A process according to claim 1, wherein said prealloyed powders contain at least 45 wt. % nickel and at least 30 wt. % titanium.

4. A process according to claim 1, wherein said prealloyed powders are nickel-titanium binary alloys containing from 53 to 62 wt. % nickel.

5. A shape memory effect alloy having a desired transition temperature, made in accordance with the process of claim 1.

* * * * *